US009931873B2

(12) United States Patent
Ogawa

(10) Patent No.: US 9,931,873 B2
(45) Date of Patent: Apr. 3, 2018

(54) INKJET PRINTER

(71) Applicant: Roland DG Corporation, Hamamatsu-shi, Shizuoka (JP)

(72) Inventor: Youichirou Ogawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/293,430

(22) Filed: Oct. 14, 2016

(65) Prior Publication Data

US 2017/0028753 A1 Feb. 2, 2017

Related U.S. Application Data

(63) Continuation of application No. PCT/JP2015/057014, filed on Mar. 10, 2015.

(30) Foreign Application Priority Data

Apr. 17, 2014 (JP) ..... 2014-085569

(51) Int. Cl.
*B41J 23/00* (2006.01)
*B41J 25/00* (2006.01)
(Continued)

(52) U.S. Cl.
CPC ..... *B41J 25/006* (2013.01); *B41J 2/01* (2013.01); *B41J 11/002* (2013.01)

(58) Field of Classification Search
None
See application file for complete search history.

(56) References Cited

U.S. PATENT DOCUMENTS

2003/0184631 A1 10/2003 Suzuki et al.
2004/0104964 A1* 6/2004 Niekawa ..... B41J 2/145 347/40
(Continued)

FOREIGN PATENT DOCUMENTS

JP 2004-202864 A 7/2004
JP 2004-314304 A 11/2004
(Continued)

OTHER PUBLICATIONS

Official Communication issued in International Patent Application No. PCT/JP2015/057014, dated Apr. 14, 2015.

*Primary Examiner* — Erica Lin
(74) *Attorney, Agent, or Firm* — Keating & Bennett, LLP

(57) ABSTRACT

In an inkjet printer, from one side of a main scanning direction, first through fourth ultraviolet irradiation devices arrayed in the main scanning direction at least partially overlap first and second recording heads. A distance in the main scanning direction between a middle position in the main scanning direction of the first recording head and a middle position in the main scanning direction of the first ultraviolet irradiation device is equal to a distance in the main scanning direction between the middle position of the first recording head and a middle position in the main scanning direction of the second ultraviolet irradiation device. A distance in the main scanning direction between a middle position in the main scanning direction of the second recording head and a middle position in the main scanning direction of the third ultraviolet irradiation device is equal to a distance in the main scanning direction between the middle position of the second recording head and a middle position in the main scanning direction of the fourth ultraviolet irradiation device.

3 Claims, 8 Drawing Sheets

(51) Int. Cl.
*B41J 11/00* (2006.01)
*B41J 2/01* (2006.01)

(56) References Cited

U.S. PATENT DOCUMENTS

| | | | | |
|---|---|---|---|---|
| 2010/0182378 | A1* | 7/2010 | Mitsuzawa | B41J 2/145 347/51 |
| 2011/0102505 | A1 | 5/2011 | Kagami et al. | |
| 2011/0249062 | A1 | 10/2011 | Nakano et al. | |
| 2012/0120168 | A1* | 5/2012 | Kachi | B41J 11/002 347/102 |

FOREIGN PATENT DOCUMENTS

| | | | |
|---|---|---|---|
| JP | 4457622 | B2 | 4/2010 |
| JP | 2011-093179 | A | 5/2011 |
| JP | 2011-218624 | A | 11/2011 |

* cited by examiner

INKJET PRINTER

CROSS REFERENCE TO RELATED APPLICATIONS

This application claims the benefit of priority to Japanese Patent Application 2014-085569 filed on Apr. 17, 2014 and is a Continuation Application of PCT/JP2015/057014 filed on Mar. 10, 2015. The entire contents of each application are hereby incorporated herein by reference.

BACKGROUND OF THE INVENTION

1. Field of the Invention

The present invention relates to an inkjet printer.

2. Description of the Related Art

Conventionally, an inkjet printer is known including a recording head injecting ink that is cured when being irradiated with ultraviolet rays (hereinafter, referred to as "ultraviolet-curable ink") toward a recording medium such as a recording paper sheet or the like and an ultraviolet irradiation device irradiating the ultraviolet-curable ink injected onto the recording medium with ultraviolet rays (e.g., Japanese Laid-Open Patent Publication No. 2011-93179 and Japanese Patent No. 4457622).

Also known is an inkjet printer 100 shown in FIG. 8 including a first recording head 141, a second recording head 142, a first ultraviolet irradiation device 151, and a second ultraviolet irradiation device 152. In the inkjet printer 100, the recording medium is located below the first recording head 141 and the second recording head 142. The first recording head 141 and the second recording head 142 inject ultraviolet-curable ink toward the recording medium while moving in a direction, of a main scanning direction Y, from one side to the other side (hereinafter, such a direction will be referred to as a "forward direction Y1") and a direction, of the main scanning direction Y, from the other side to the one side (hereinafter, such a direction will be referred to as a "backward direction Y2"). The second recording head 142 is provided on the one side of the main scanning direction Y with respect to the first recording head 141. The first ultraviolet irradiation device 151 is provided on the other side of the main scanning direction Y with respect to the first recording head 141. The second ultraviolet irradiation device 152 is provided on the one side of the main scanning direction Y with respect to the second recording head 142. The ultraviolet-curable ink injected by the first recording head 141 and the second recording head 142 while the first recording head 141 and the second recording head 142 are moving in the forward direction Y1 is cured by ultraviolet rays provided by the second ultraviolet irradiation device 152. In contrast, the ultraviolet-curable ink injected by the first recording head 141 and the second recording head 142 while the first recording head 141 and the second recording head 142 are moving in the backward direction Y2 is cured by ultraviolet rays provided by the first ultraviolet irradiation device 151.

In the inkjet printer 100, distance D101 in the main scanning direction Y between middle position L101 in the main scanning direction Y of the first recording head 141 and middle position L103 in the main scanning direction Y of the first ultraviolet irradiation device 151, and distance D102 in the main scanning direction Y between middle position L101 of the first recording head 141 and middle position L104 in the main scanning direction Y of the second ultraviolet irradiation device 152, are different from each other. Similarly, distance D103 in the main scanning direction Y between middle position L102 in the main scanning direction Y of the second recording head 142 and middle position L103 of the first ultraviolet irradiation device 151, and distance D104 in the main scanning direction Y between middle position L102 of the second recording head 142 and middle position L104 of the second ultraviolet irradiation device 152, are different from each other. Therefore, for example, the time until the ultraviolet ink injected onto the recording medium from the first recording head 141 moving in the forward direction Y1 is cured, and the time until the ultraviolet ink injected onto the recording medium from the first recording head 141 moving in the backward direction Y2 is cured, are different from each other. As the time until the ultraviolet ink is cured is longer, a dot of the ultraviolet ink has a longer diameter. Therefore, in this case, the ink dots of the ultraviolet ink injected onto the recording medium may be different in accordance with whether the ink is injected in the forward direction Y1 or the backward direction Y2. This may result in printing unevenness caused as a result of printing.

SUMMARY OF THE INVENTION

Preferred embodiments of the present invention provide an inkjet printer capable of significantly reducing or preventing printing unevenness.

An inkjet printer according to a preferred embodiment of the present invention includes a guide rail, a first recording head, a second recording head, a first ultraviolet irradiation device, a second ultraviolet irradiation device, a third ultraviolet irradiation device, and a fourth ultraviolet irradiation device. The guide rail extends in a main scanning direction. The first recording head is slidably in engagement with the guide rail. The first recording head injects ultraviolet-curable ink toward a recording medium at least either while moving in a forward direction from one side to the other side of the main scanning direction or while moving in a backward direction from the other side to the one side of the main scanning direction. The second recording head is provided on the one side or the other side of the main scanning direction with respect to the first recording head. The second recording head is slidably in engagement with the guide rail. The second recording head injects ultraviolet-curable ink toward the recording medium at least either while moving in the forward direction or while moving in the backward direction. The first ultraviolet irradiation device is provided on the other side of the main scanning direction with respect to the first recording head, and irradiates the ultraviolet-curable ink injected onto the recording medium with ultraviolet rays. The second ultraviolet irradiation device is provided on the one side of the main scanning direction with respect to the first recording head, and irradiates the ultraviolet-curable ink injected onto the recording medium with ultraviolet rays. The third ultraviolet irradiation device is provided on the other side of the main scanning direction with respect to the second recording head, and irradiates the ultraviolet-curable ink injected onto the recording medium with ultraviolet rays. The fourth ultraviolet irradiation device is provided on the one side of the main scanning direction with respect to the second recording head, and irradiates the ultraviolet-curable ink injected onto the recording medium with ultraviolet rays. The first recording head includes a first nozzle line, a second nozzle line, a third nozzle line and a fourth nozzle line each including a plurality of nozzles arrayed in a sub scanning direction perpendicular to the main scanning direction. The first nozzle line and the second nozzle line inject first ink. The third nozzle line and the fourth nozzle line inject second ink. As seen from the one side of the main scanning direction, each of the first ultraviolet irradiation device, the second ultraviolet irradiation device, the third ultraviolet irradiation device and the fourth ultraviolet irradiation device at least partially overlaps the first recording head and the second recording head. A distance in the main scanning direction between a middle position in the main scanning direction of the first recording head and a middle position in the main scanning direction of the first ultraviolet irradiation device is equal to a distance in the main scanning direction between the middle position in the main scanning direction of the first recording head and a middle position in the main scanning direction of the second ultraviolet irradiation device. A distance in the main scanning direction between a middle position in the main scanning direction of the second recording head and a middle position in the main scanning direction of the third ultraviolet irradiation device is equal to a distance in the main scanning direction between the middle position in the main scanning direction of the second recording head and a middle position in the main scanning direction of the fourth ultraviolet irradiation device. The first nozzle line and the third nozzle line are located on the one side of the main scanning direction with respect to the middle position in the main scanning direction of the first recording head. The second nozzle line and the fourth nozzle line are located on the other side of the main scanning direction with respect to the middle position in the main scanning direction of the first recording head. A distance in the main scanning direction between the middle position in the main scanning direction of the first recording head and the first nozzle line is equal to a distance in the main scanning direction between the middle position in the main scanning direction of the first recording head and the second nozzle line. A distance in the main scanning direction between the middle position in the main scanning direction of the first recording head and the third nozzle line is equal to a distance in the main scanning direction between the middle position in the main scanning direction of the first recording head and the fourth nozzle line.

According to a preferred embodiment of an inkjet printer, the distance in the main scanning direction between the middle position in the main scanning direction of the first recording head and the middle position in the main scanning direction of the first ultraviolet irradiation device is equal to the distance in the main scanning direction between the middle position in the main scanning direction of the first recording head and the middle position in the main scanning direction of the second ultraviolet irradiation device. For example, the ultraviolet-curable ink injected by the first recording head while the first recording head is moving in the forward direction is cured by being irradiated with the ultraviolet rays provided by the second ultraviolet irradiation device. The ultraviolet-curable ink injected by the first recording head while the first recording head is moving in the backward direction is cured by being irradiated with the ultraviolet rays provided by the first ultraviolet irradiation device. Therefore, the time after the ultraviolet-curable ink injected by the first recording head while the first recording head is moving in the forward direction arrives at the recording medium until the ultraviolet-curable ink starts to be cured by ultraviolet rays is equal to the time after the ultraviolet-curable ink injected by the first recording head while the first recording head is moving in the backward direction arrives at the recording medium until the ultraviolet-curable ink starts to be cured by ultraviolet rays. Thus, the diameter of a dot of the ultraviolet-curable ink injected by the first recording head while the first recording head is moving in the forward direction is equal to the diameter of a dot of the ultraviolet-curable ink injected by the first recording head while the first recording head is moving in the backward direction. This significantly reduces or prevents printing unevenness on a printed item created by the ultraviolet-curable ink injected by the first recording head onto the recording medium.

A distance in the main scanning direction between a middle position in the main scanning direction of the second recording head and a middle position in the main scanning direction of the third ultraviolet irradiation device is equal to a distance in the main scanning direction between the middle position in the main scanning direction of the second recording head and a middle position in the main scanning direction of the fourth ultraviolet irradiation device. For example, the ultraviolet-curable ink injected by the second recording head while the second recording head is moving in the forward direction is cured by being irradiated with the ultraviolet rays provided by the fourth ultraviolet irradiation device. The ultraviolet-curable ink injected by the second recording head while the second recording head is moving in the backward direction is cured by being irradiated with the ultraviolet rays provided by the third ultraviolet irradiation device. Therefore, the time after the ultraviolet-curable ink injected by the second recording head while the second recording head is moving in the forward direction arrives at the recording medium until the ultraviolet-curable ink starts to be cured by ultraviolet rays is equal to the time after the ultraviolet-curable ink injected by the second recording head while the second recording head is moving in the backward direction arrives at the recording medium until the ultraviolet-curable ink starts to be cured by ultraviolet rays. Thus, the diameter of a dot of the ultraviolet-curable ink injected by the second recording head while the second recording head is moving in the forward direction is equal to the diameter of a dot of the ultraviolet-curable ink injected by the second recording head while the second recording head is moving in the backward direction. This significantly reduces or prevents printing unevenness on a printed item created by the ultraviolet-curable ink injected by the second recording head onto the recording medium.

According to a preferred embodiment of an inkjet printer, a distance in the main scanning direction between the middle position in the main scanning direction of the first recording head and the first nozzle line is equal to a distance in the main scanning direction between the middle position in the main scanning direction of the first recording head and the second nozzle line. Therefore, the time until the ink injected from the nozzles of the first nozzle line is cured by ultraviolet rays is equal to the time until the ink injected from the nozzles of the second nozzle line is cured by ultraviolet rays. Thus, the diameters of dots of the ink injected from the nozzles of the first nozzle line and the nozzles of the second nozzle line are equal to each other. Similarly, the diameters of dots of the ink injected from the nozzles of the third nozzle line and the nozzles of the fourth nozzle line are equal to each other. This significantly reduces or prevents printing unevenness on a printed item created by the ink injected by the first recording head onto the recording medium.

Various preferred embodiments of the present invention provide an inkjet printer capable that significantly reduces or prevents printing unevenness.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, inkjet printers (hereinafter, referred to individually as a "printer") according to preferred embodiments of the present invention will be described. The preferred embodiments described below are not intended to specifically limit the present invention in any way. Elements, portions and features having identical functions bear identical reference signs, and the same descriptions may be omitted appropriately or simplified.

First Preferred Embodiment

Figure 1:
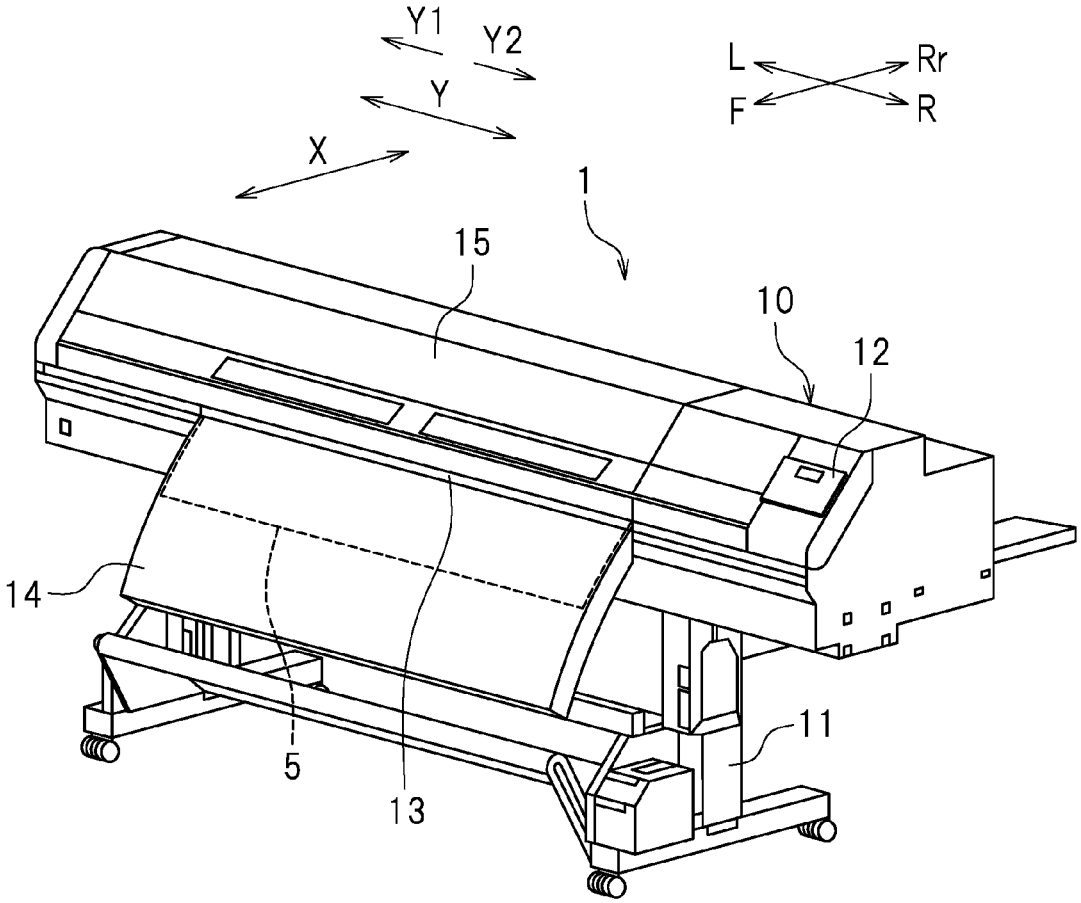
FIG. 1 is a perspective view of a printer according to a preferred embodiment of the present invention.
Figure 2:
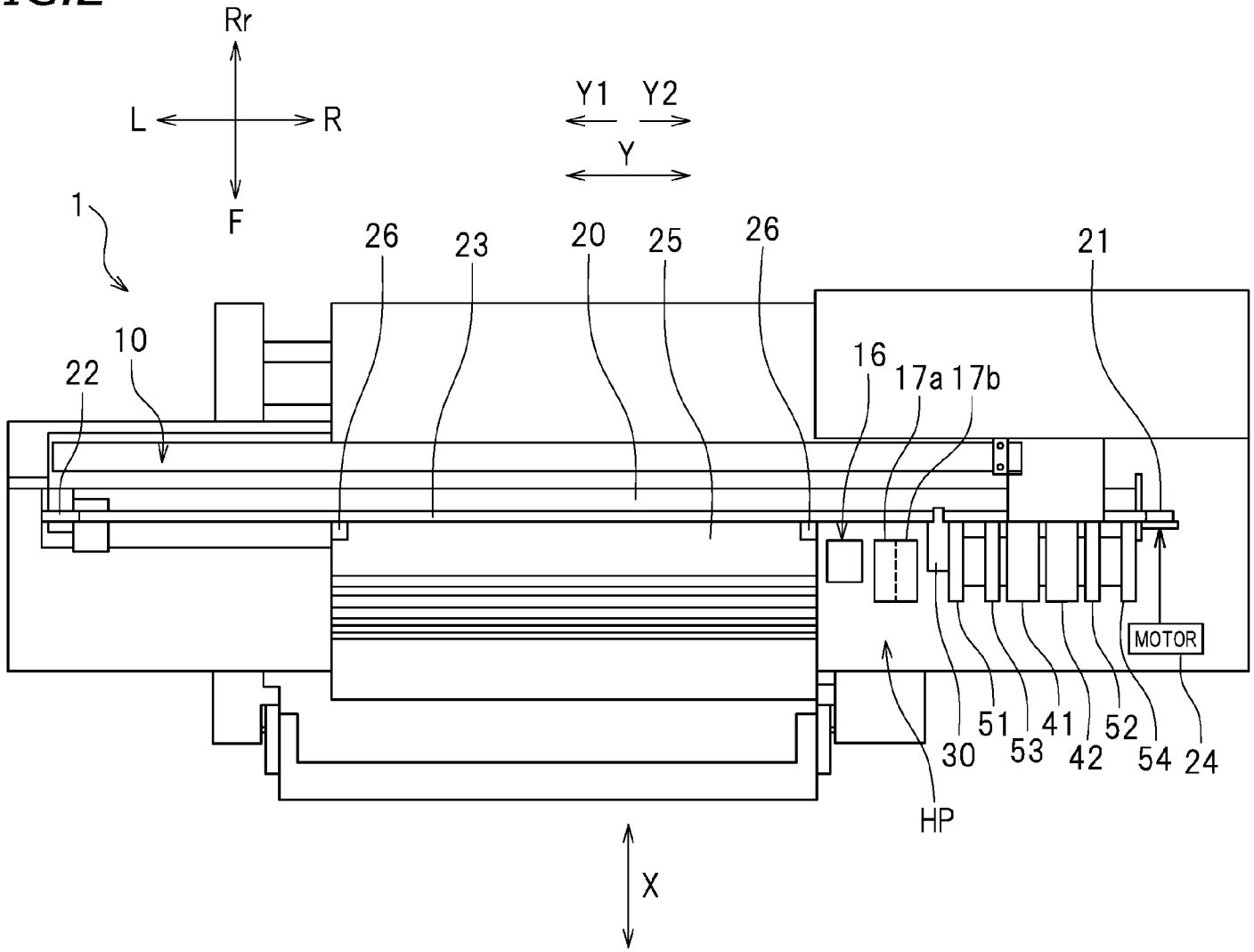
FIG. 2 is a plan view showing an inner structure of the printer.

First, a printer 1 according to a first preferred embodiment of the present invention will be described. FIG. 1 is a perspective view of the printer 1 according to the first preferred embodiment. FIG. 2 is a plan view showing an inner structure of the printer 1. In the drawings referred to below, reference signs F, Rr, L and R respectively represent front, rear, left and right. These directions are provided merely for the sake of convenience, and do not limit the form of installment of the printer 1 in any way. Reference sign Y represents a main scanning direction. Reference sign X represents a sub scanning direction perpendicular to the main scanning direction Y. There is no limitation on the directions used as the main scanning direction Y and the sub scanning direction X. The main scanning direction Y and the sub scanning direction X may be appropriately set in accordance with the form or the like of the printer 1.

As shown in FIG. 1, the printer 1 performs printing on a recording paper sheet 5. The recording paper sheet 5 is anon-limiting example of a recording medium. The recording paper sheet 5 preferably is a rolled recording medium, for example. The recording paper sheet 5 is a so-called rolled paper sheet. The recording medium according to various preferred embodiments of the present invention is not limited to the recording paper sheer 5. The recording medium may be, for example, a resin sheet. The recording medium is not limited to a flexible sheet. The recording medium may be, for example, a hard recording medium formed of glass or the like.

In this preferred embodiment, the printer 1 includes a printer main body 10 extending in the main scanning direction Y and a leg 11 supporting the printer main body 10. To the right of the printer main body 10, an operation panel 12 is provided. Although not shown, the operation panel 12 includes a display portion and an input portion. The display portion displays information on printing, for example, whether monochrome printing or color printing is to be performed, resolution, darkness of ink, and the like. The input portion is usable by a user to input information to be displayed on the display portion.

The printer main body 10 is provided with a cover 15. In this example, the cover 15 is attached to a top portion of the printer main body 10. The cover 15 is openable/closable. In a bottom portion of the printer main body 10, a discharge opening 13, through which the recording paper sheet 5 is discharged, is provided. At a position to the front of, and below, the discharge opening 13, a guide 14 is provided to guide the recording paper sheer 5 discharged through the discharge opening 13 in an obliquely frontward and downward direction.

Now, the inner structure of the printer main body 10 will be described. As shown in FIG. 2, the printer 1 includes a guide rail 20 and a platen 25. The guide rail 20 is located inward of the printer main body 10. The guide rail 20 extends in the main scanning direction Y.

The platen 25 supports the recording paper sheet 5 while the printer 1 performs printing on the recording paper sheet 5. The printing on the recording paper sheet 5 is performed on the platen 25. The platen 25 is located to the front of a central portion of the guide rail 20. The platen 25 extends in the main scanning direction Y.

In the vicinity of aright end of the guide rail 20, a pulley 21 is provided. In the vicinity of a left end of the guide rail 20, a pulley 22 is provided. An endless belt 23 is wound around, and extends between, the pulley 21 and the pulley 22. The pulley 21 is coupled with a servo motor 24. When the servo motor 24 drives the pulley 21, the belt 23 runs between the pulley 21 and the pulley 22. In this preferred embodiment, the pulley 21 is driven. Alternatively, the printer 1 may be configured such that the pulley 22 is driven. In this case, the servo motor 24 is coupled with the pulley 22.

A carriage 30 is attached to the belt 23. Although not shown, the carriage 30 is in engagement with the guide rail 20. Therefore, the carriage 30 moves in the main scanning direction Y along the guide rail 20 as the belt 23 runs.

At each of a left end and a right end of the platen 25, a pair of, namely, upper and lower rollers 26 are provided (in FIG. 2, only the upper rollers 26 are shown). The upper and lower rollers 26 are not limited to being located at each of the left end and the right end of the platen 25. One of the upper and lower rollers 26 of each pair is a driving roller rotating by itself. The other roller of the upper and lower rollers 26 of each pair is a pinch roller pinching the recording paper sheet 25 together with the driving roller. The pinch roller, among the rollers 26, is configured such that the position thereof in a top-down direction is changeable in accordance with the thickness of the recording paper sheet 5, and thus is operable by a user.

In this preferred embodiment, the printer 1 includes a first recording head 41 and a second recording head 42. The first recording head 41 and the second recording head 42 inject ink downward toward the recording paper sheet 5. The ink is cured when being irradiated with ultraviolet rays, namely, is ultraviolet-curable ink.

The first recording head 41 and the second recording head 42 are slidably in engagement with the guide rail 20. The first recording head 41 and the second recording head 42 are movable in the main scanning direction Y. In this preferred embodiment, the first recording head 41 and the second recording head 42 are attached to the carriage 30. The first recording head 41 and the second recording head 42 inject the ink toward the recording paper sheet 5 while moving in a forward direction Y1 and a backward direction Y2 of the main scanning direction Y. In FIG. 2 and the like, the forward direction Y1 represents a direction from the right to the left. The backward direction Y2 represents a direction from the left to the right. In the following description, the forward direction Y1 will be also referred to as a "leftward direction Y1". The backward direction Y2 will be also referred to as a "rightward direction Y2". In this preferred embodiment, the printer 1 is able to print in both directions. Although not shown, an ink cartridge filled with the ink is provided to the rear of the printer main body 10. The first recording head 41 and the second recording head 42 are connected with the cartridge via a tube (not shown) or the like. The first recording head 41 and the second recording head 42 are supplied with the ink from the ink cartridge. In this preferred embodiment, while the first recording head 41 and the second recording head 42 are moving in the leftward direction Y1 and the rightward direction Y2 of the main scanning direction Y, only one of the first recording head 41 and the second recording head 42 injects the ink. Namely, while the ink is injected from the first recording head 41, no ink is injected from the second recording head 42. While the ink is injected from the second recording head 42, no ink is injected from the first recording head 41.

Figure 3:
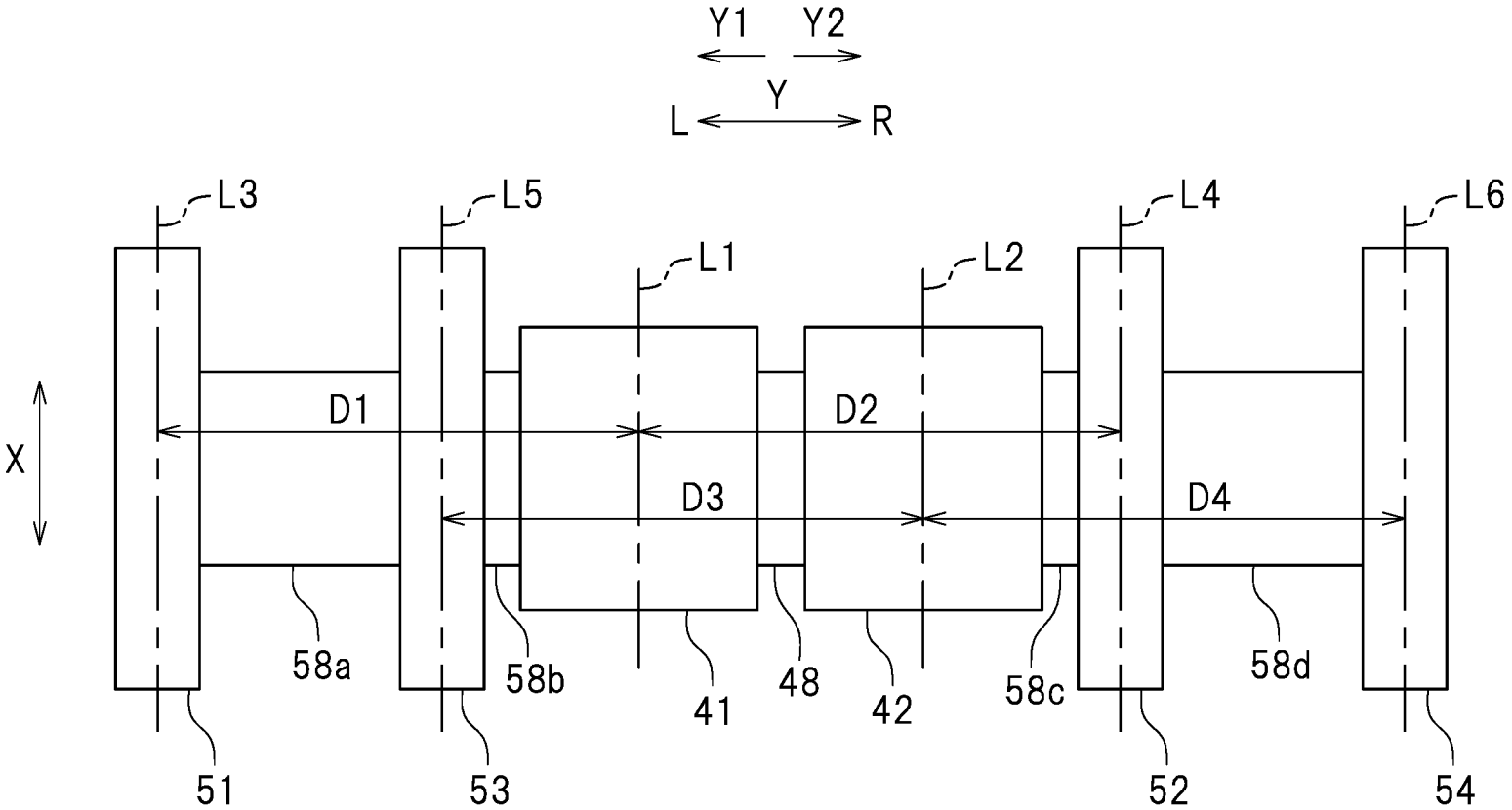
FIG. 3 schematically shows a first recording head, a second recording head, a first ultraviolet irradiation device, a second ultraviolet irradiation device, a third ultraviolet irradiation device and a fourth ultraviolet irradiation device.

FIG. 3 is a plan view schematically showing the first recording head 41, the second recording head 42, a first ultraviolet irradiation device 51, a second ultraviolet irradiation device 52, a third ultraviolet irradiation device 53 and a fourth ultraviolet irradiation device 54. As shown in FIG. 3, the first recording head 41 and the second recording head 42 are independent of each other. In this example, the first recording head 41 is coupled with the second recording head 42 via a coupling member 48. Alternatively, the first recording head 41 and the second recording head 42 may be integrally formed. The first recording head 41 and the second recording head 42 are located at positions shifted from each other in the main scanning direction Y. In this preferred embodiment, the first recording head 41 is provided to the left of the second recording head 42. Alternatively, the first recording head 41 may be provided to the right of the second recording head 42. The first recording head 41 and the second recording head 42 are arrayed in the main scanning direction Y. In this example, the first recording head 41 and the second recording head 42 are located at positions completely matched to each other in the sub scanning direction X. Alternatively, the first recording head 41 and the second recording head 42 may be located at positions shifted from each other in the sub scanning direction X. There is no specific limitation on the size of each of the first recording head 41 and the second recording head 42. The first recording head 41 and the second recording head 42 may have the same size as each other or may have different sizes from each other. For example, the first recording head 41 and the second recording head 42 may each have a length of about 30 mm in the main scanning direction Y. The first recording head 41 and the second recording head 42 may each have a length of about 40 mm in the sub scanning direction X.

The ink injected from the first recording head 41 is, for example, cyan ink (C), magenta ink (M), yellow ink (Y) and black ink (B). Each of the cyan ink, the magenta ink, the yellow ink and the black ink is ink usable to form a color image, and is so-called process color ink. There is no specific limitation on the types and the number of types of the ink injected from the first recording head 41. For example, the first recording ink 41 may inject six types of ink including the cyan ink, the magenta ink, the yellow ink and the black ink described above and light cyan ink and light magenta ink. In this example, for example, the cyan ink corresponds to "first ink", and the magenta ink corresponds to "second ink".

Figure 4:
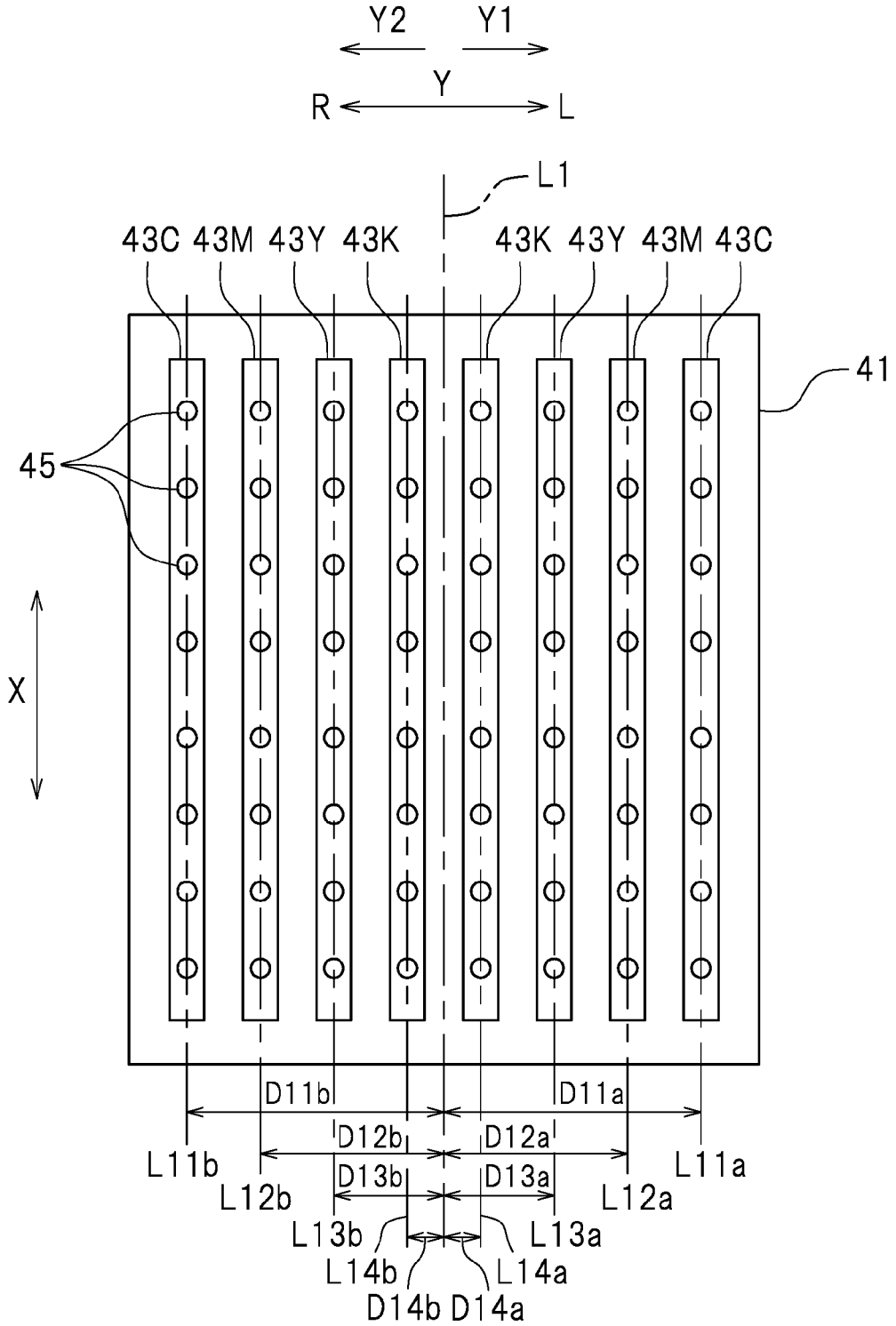
FIG. 4 schematically shows injection portions of the first recording head.

FIG. 4 schematically shows injection portions 43C, 43M, 43Y and 43K of the first recording head 41, and shows the first recording head 41 as seen from a bottom surface thereof. As shown in FIG. 4, the first recording head 41 includes a plurality of injection portions each including an array of a plurality of nozzles located in the sub scanning direction X. The first recording head includes two injection portions 43C injecting cyan ink, two injection portions 43M injecting magenta ink, two injection portions 43Y injecting yellow ink, and two injection portions 43K injecting black ink.

The injection portions 43C, 43M, 43Y and 43K each include an array of a plurality of nozzles 45 located in the sub scanning direction X. In FIG. 4, each of the injection portions 43C, 43M, 43Y and 43K includes eight nozzles 45. In actuality, however, each of the injection portions 43C, 43M, 43Y and 43K includes a large number of (for example, eight or more) nozzles 45. The injection portions 43C, 43M, 43Y and 43K are arrayed in the main scanning direction Y. One of the injection portions 43C, one of the injection portions 43M, one of the injection portions 43Y, and one of the injection portions 43K are located on one side, namely, on the right side, of the main scanning direction Y, with respect to middle position L1 in the main scanning direction Y of the first recording head 41. The other of the injection portions 43C, the other of the injection portions 43M, the other of the injection portions 43Y, and the other of the injection portions 43K are located on the other side, namely, on the left side, of the main scanning direction Y, with respect to middle position L1 in the main scanning direction Y of the first recording head 41. In this example, for example, the right injection portion 43C of the two injection portions 43C corresponds to a "first nozzle line". The left injection portion 43C of the two injection portions 43C corresponds to a "second nozzle line". For example, the right injection portion 43M of the two injection portions 43M corresponds to a "third nozzle line". The left injection portion 43M of the two injection portions 43M corresponds to a "fourth nozzle line".

Distance D11*a* between middle position L1 in the main scanning direction Y of the first recording head 41 and middle position L11*a* in the main scanning direction Y of the left injection portion 43C is equal to distance D11*b* between middle position L1 in the main scanning direction Y of the first recording head 41 and middle position L11*b* in the main scanning direction Y of the right injection portion 43C. Similarly, distance D12*a* between middle position L1 of the first recording head 41 and middle position L12*a* in the main scanning direction Y of the left injection portion 43M is equal to distance D12*b* between middle position L1 of the first recording head 41 and middle position L12*b* in the main scanning direction Y of the right injection portion 43M. Distance D13*a* between middle position L1 of the first recording head 41 and middle position L13*a* in the main scanning direction Y of the left injection portion 43Y is equal to distance D13*b* between middle position L1 of the first recording head 41 and middle position L13*b* in the main scanning direction Y of the right injection portion 43Y. Distance D14*a* between middle position L1 of the first recording head 41 and middle position L14*a* in the main scanning direction Y of the left injection portion 43K is equal to distance D14*b* between middle position L1 of the first recording head 41 and middle position L14*b* in the main scanning direction Y of the right injection portion 43K.

In this example, in both of the leftward direction Y1 and the rightward direction Y2, the plurality of injection portions of the first recording head 41 are located in the order of the injection portions 43C, 43M, 43Y, 43K, 43K, 43Y, 43M and 43C. In this preferred embodiment, as seen in a plan view, the injection portions 43C, 43M, 43Y and 43K are located so as to be linear-symmetrical, with middle position L1 in the main scanning direction Y of the first recording head 41 being the axis of symmetry. It should be noted that there is no specific limitation on the order of the positions of the injection portions 43C, 43M, 43Y and 43K. In this example, the injection portions 43C, 43M, 43Y and 43K are arrayed in the main scanning direction Y at an equal interval. In this preferred embodiment, the injection portions 43C, 43M, 43Y and 43K are independent of each other. Alternatively, the injection portions 43C, 43M, 43Y and 43K may be integral with each other partially or entirely. In each of the injection portions 43C, 43M, 43Y and 43K, the nozzles 45 may be located in one line as shown in FIG. 4, or may be located in two or more lines. In this example, among the plurality of nozzles 45 of the injection portions 43C, 43M, 43Y and 43K, nozzles 45 adjacent to each other in the main scanning direction Y are located linearly in the main scanning direction Y. For example, the nozzles 45 located at one end of the injection portions 43C, 43M, 43Y and 43K are located linearly in the main scanning direction Y. Alternatively, among the plurality of nozzles 45 of the injection portions 43C, 43M, 43Y and 43K, nozzles 45 adjacent to each other in the main scanning direction Y may be located to be shifted from each other in the sub scanning direction X. Namely, the nozzles 45 may be located in a zigzag manner.

The ink injected from the second recording head 42 is, for example, gloss ink (G), white ink (W) and primer ink (P). The gloss ink is ink mainly injected toward a surface of the process color ink injected onto the recording paper sheet 5. The gloss ink is transparent ink, and is used to provide a printed item with a glossy surface. The white ink is used to print the recording medium white. The white ink may be used to provide underlying printing when, for example, the recording paper sheet 5 is of a color different from white. The process color ink is injected toward the recording paper sheet 5 already having the white ink injected thereon, so that the recording paper sheet 5 is printed with the color of the process color ink with no influence of the original color of the recording paper sheet 5. The primer ink is a so-called under-layer processing agent. The primer ink is injected toward the recording paper sheet 5 before the process color ink is injected toward the recording paper sheet 5. The gloss ink, the white ink and the primer ink are so-called spot color ink. The spot color ink is ink other than the process color ink. The spot color ink is used together with the process color ink. In this example, for example, the gloss ink corresponds to "third ink", and the white ink corresponds to "fourth ink".

Figure 5:
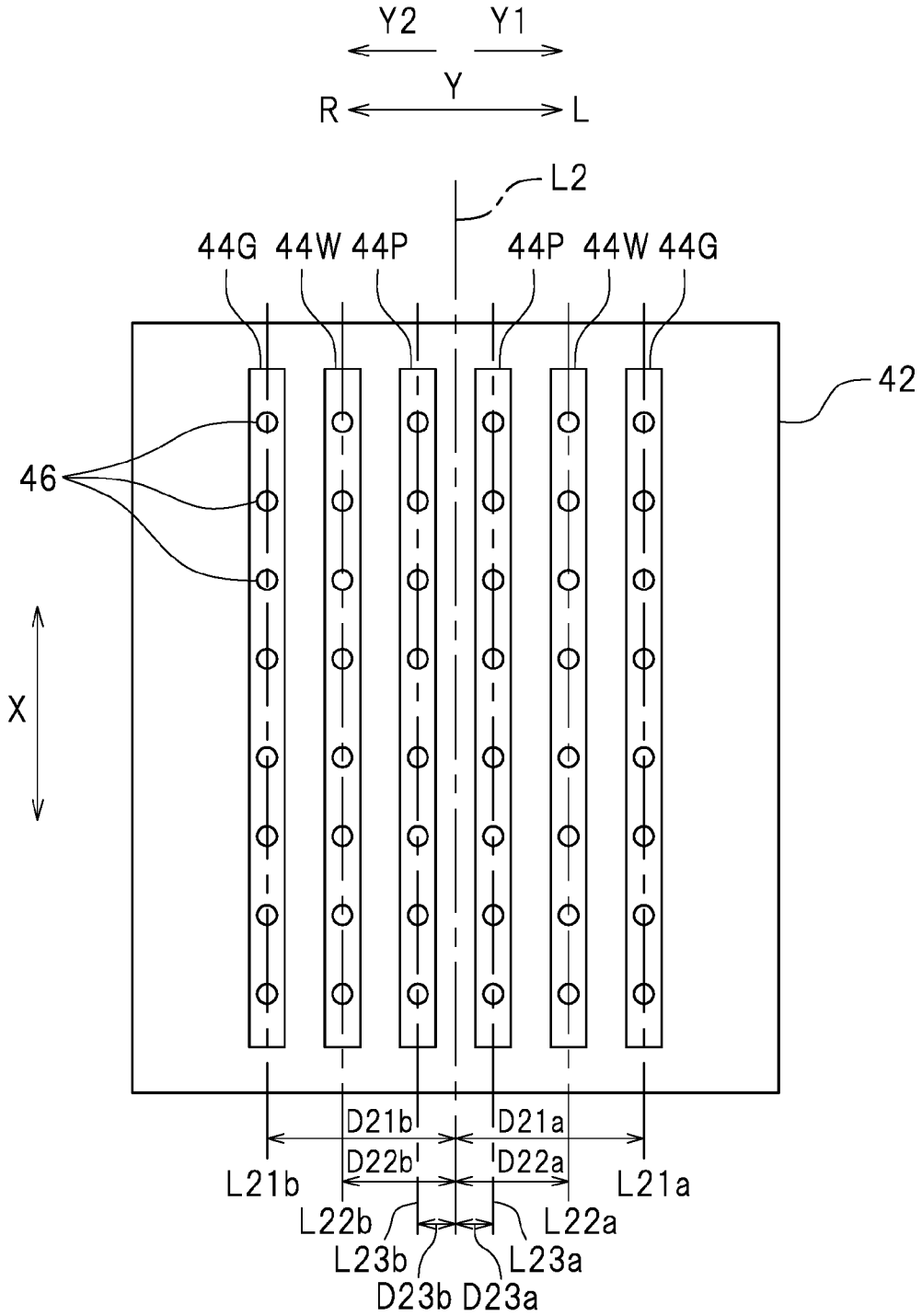
FIG. 5 schematically shows injection portions of the second recording head.

FIG. 5 schematically shows injection portions 44G, 44W and 44P of the second recording head 42, and shows the second recording head 42 as seen from a bottom surface thereof. As shown in FIG. 5, the second recording head 42 includes a plurality of injection portions each including an array of a plurality of nozzles located in the sub scanning direction X. The second recording head 42 includes two injection portions 44G injecting gloss ink, two injection portions 44W injecting white ink, and two injection portions 44P injecting primer ink.

The injection portions 44G, 44W and 44P each include an array of a plurality of nozzles 46 located in the sub scanning direction X. In FIG. 5, each of the injection portions 44G, 44W and 44P preferably includes eight nozzles 46, for example. In actuality, however, each of the injection portions 44G, 44W and 44P includes a large number of nozzles 46. The injection portions 44G, 44W and 44P are arrayed in the main scanning direction Y. One of the injection portions 44G, one of the injection portions 44W, and one of the injection portions 44P are located on one side, namely, on the right side, of the main scanning direction Y, with respect to middle position L2 in the main scanning direction Y of the second recording head 42. The other of the injection portions 44G, the other of the injection portions 44M, and the other of the injection portions 44P are located on the other side, namely, on the left side, of the main scanning direction Y, with respect to middle position L2 in the main scanning direction Y of the second recording head 42. In this example, for example, the right injection portion 44G of the two injection portions 44G corresponds to a "fifth nozzle line". The left injection portion 44G of the two injection portions 44G corresponds to a "sixth nozzle line". For example, the right injection portion 44W of the two injection portions 44W corresponds to a "seventh nozzle line". The left injection portion 44W of the two injection portions 44W corresponds to an "eighth nozzle line".

Distance D21*a* between middle position L2 in the main scanning direction Y of the second recording head 42 and middle position L21*a* in the main scanning direction Y of the left injection portion 44G is equal to distance D21*b* between middle position L2 in the main scanning direction Y of the second recording head 42 and middle position L21*b* in the main scanning direction Y of the right injection portion 44G. Similarly, distance D22*a* between middle position L2 of the second recording head 42 and middle position L22*a* in the main scanning direction Y of the left injection portion 44W is equal to distance D22*b* between middle position L2 of the second recording head 42 and middle position L22*b* in the main scanning direction Y of the right injection portion 44W. Distance D23*a* between middle position L2 of the second recording head 42 and middle position L23*a* in the main scanning direction Y of the left injection portion 44P is equal to distance D23*b* between middle position L2 of the second recording head 42 and middle position L23*b* in the main scanning direction Y of the right injection portion 44P.

In this example, in both of the leftward direction Y1 and the rightward direction Y2, the plurality of injection portions of the second recording head 42 are located in the order of the injection portions 44G, 44W, 44P, 44P, 44W and 44G. In this preferred embodiment, as seen in a plan view, the injection portions 44G, 44W and 44P are located so as to be linear-symmetrical, with middle position L2 in the main scanning direction Y of the second recording head 42 being the axis of symmetry. It should be noted that there is no specific limitation on the order of the positions of the injection portions 44G, 44W and 44P. In this example, the injection portions 44G, 44W and 44P are arrayed in the main scanning direction Y at an equal interval. In this preferred embodiment, the injection portions 44G, 44W and 44P are independent of each other. Alternatively, the injection portions 44G, 44W and 44P may be integral with each other partially or entirely. In each of the injection portions, the nozzles 46 may be located in one line as shown in FIG. 5, or may be located in two or more lines. In this example, among the plurality of nozzles 46 of the injection portions 44G, 44W and 44P, nozzles 46 adjacent to each other in the main scanning direction Y are located linearly in the main scanning direction Y. For example, the nozzles 46 located at one end of the injection portions 44G, 44W and 44P are located linearly in the main scanning direction Y. Alternatively, among the plurality of nozzles 46 of the injection portions 44G, 44W and 44P, nozzles 46 adjacent to each other may be located to be shifted from each other in the sub scanning direction X. Namely, the nozzles 46 may be located in a zigzag manner.

As shown in FIG. 2, a container 16 opened upward and wipers 17*a* and 17*b* are located to the right of the platen 25. The container 16 receives the ink injected from the first recording head 41 and the second recording head 42 when the first recording head 41 and the second recording head 42 arrive at a home position HP, which is a wait position. When the ink in the first recording head 41 and the second recording head 42 makes contact with the air, the viscosity of the ink is increased. When the viscosity of the ink is increased, the injection performance of the first recording head 41 and the second recording head 42 may be undesirably changed. Thus, the first recording head 41 and the second recording head 42 inject the ink toward the container 16 when necessary in order to improve the reliability of the injection performance thereof. The container 16 recovers the ink injected from the first recording head 41 and the second recording head 42 when such an operation is performed. The container 16 recovers the process color ink injected from the first recording head 41 and the spot color ink injected from the second recording head 42. In this example, the process color ink injected from the first recording head 41 toward the container 16 is not easily attached to the second recording head 42. The spot color ink injected from the second recording head 42 toward the container 16 is not easily attached to the first recording head 41.

The wiper 17*a* cleans a nozzle surface (a surface on which the injection portions are provided) of the first recording head 41. The wiper 17*b* cleans a nozzle surface of the second recording head 42. While moving toward the home position HP, the first recording head 41 and the second recording head 42 are appropriately slid by the wiper 17*a* and the wiper 17*b*, respectively. This removes the ink or the like unnecessarily attached to the first recording head 41 and the second recording head 42. In this preferred embodiment, the wiper 17*b* removes the spot color ink on the second recording head 42, and thus the spot color ink is prevented from being attached to the nozzle surface of the first recording head 41. The wiper 17*a* removes the process color ink on the first recording head 41, and thus the process color ink is prevented from being attached to the nozzle surface of the second recording head 42. In this example, the operation of injecting the ink toward the container 16 made by the first recording head 41 and the second recording head 42 and the operation of cleaning the nozzle surfaces of the first recording head 41 and the second recording head 42 made respectively by the wipers 17*a* and 17*b* are comprehensively referred to as "head cleaning".

As shown in FIG. 3, the printer 1 includes a first ultraviolet irradiation device 51, a second ultraviolet irradiation device 52, a third ultraviolet irradiation device 53, and a fourth ultraviolet irradiation device 54. The ultraviolet irradiation devices 51, 52, 53 and 54 irradiate the ink injected onto the recording paper sheet 5 with ultraviolet rays. In this preferred embodiment, the ultraviolet irradiation devices 51, 52, 53 and 54 each include a plurality of ultraviolet emitting diodes, for example. The ultraviolet irradiation devices 51, 52, 53 and 54 may each include, for example, a halogen lamp or the like.

Now, the positional relationship among the first recording head 41, the second recording head 42, the first ultraviolet irradiation device 51, the second ultraviolet irradiation device 52, the third ultraviolet irradiation device 53 and the fourth ultraviolet irradiation device 54 will be described. The ultraviolet irradiation devices 51, 52, 53 and 54 move together with the first recording head 41 and the second recording head 42. As seen from the one side and the other side of the main scanning direction Y, each of the first ultraviolet irradiation device 51, the second ultraviolet irradiation device 52, the third ultraviolet irradiation device 53 and the fourth ultraviolet irradiation device 54 at least partially overlaps the first recording head 41 and the second recording head 42. The ultraviolet irradiation devices 51, 52, 53 and 54 may overlap the first recording head 41 and the second recording head 42 entirely or only partially. The ultraviolet irradiation devices 51, 52, 53 and 54 each have a length in the sub scanning direction X that is longer than, or equal to, a length between the most front end of the first recording head 41 and the second recording head 42 and the rearmost end thereof. The ultraviolet irradiation devices 51, 52, 53 and 54 may each have a length of, for example, about 60 mm in the sub scanning direction X. The ultraviolet irradiation devices 51, 52, 53 and 54 may each have a length of, for example, about 10 mm in the main scanning direction Y. In this example, the length of each of the ultraviolet irradiation devices 51, 52, 53 and 54 in the sub scanning direction X is longer than, or equal to, each of the length of the first recording head 41 in the sub scanning direction X and the length of the second recording head 42 in the sub scanning direction X. In this preferred embodiment, the ultraviolet irradiation devices 51, 52, 53 and 54 preferably have the same size as each other. Alternatively, the ultraviolet irradiation devices 51, 52, 53 and 54 may have different sizes from each other.

The first ultraviolet irradiation device 51, the second ultraviolet irradiation device 52, the third ultraviolet irradiation device 53 and the fourth ultraviolet irradiation device 54 are arrayed in the main scanning direction Y. The first ultraviolet irradiation device 51 and the third ultraviolet irradiation device 53 are located to the left of the first recording head 41 and the second recording head 42. The third ultraviolet irradiation device 53 is located between the first ultraviolet irradiation device 51 and the first recording head 41. The first ultraviolet irradiation device 51 is attached to the left of the third ultraviolet irradiation device 53 via a coupling member 58*a*. The third ultraviolet irradiation device 53 is attached to the left of the first recording head 41 via a coupling member 58*b*. The second ultraviolet irradiation device 52 and the fourth ultraviolet irradiation device 54 are located to the right of the first recording head 41 and the second recording head 42. The second ultraviolet irradiation device 52 is located between the second recording head 42 and the fourth ultraviolet irradiation device 54. The second ultraviolet irradiation device 52 is attached to the right of the second recording head 42 via a coupling member 58*c*. The fourth ultraviolet irradiation device 54 is attached to the right of the second ultraviolet irradiation device 52 via a coupling member 58*d*.

Distance D1 in the main scanning direction Y between middle position L1 in the main scanning direction Y of the first recording head 41 and middle position L3 in the main scanning direction Y of the first ultraviolet irradiation device 51 is equal to distance D2 in the main scanning direction Y between middle position L1 of the first recording head 41 and middle position L4 in the main scanning direction Y of the second ultraviolet irradiation device 52. Now, among the plurality of injection portions of the first recording head 41, the injection portions injecting the same color of ink will be referred to. The distance between the middle position in the main scanning direction Y of the left injection portion and middle position L3 of the first ultraviolet irradiation device 51 is equal to the distance between the middle position in the main scanning direction Y of the right injection portion and middle position L4 of the second ultraviolet irradiation device 52. For example, in FIG. 4, the injection portions 43C injecting the cyan ink will be referred to. The distance between middle position L11*a* of the left injection portion 43C and middle position L3 of the first ultraviolet irradiation device 51 is equal to the distance between middle position L11*b* of the right injection portion 43C and middle position L4 of the second ultraviolet irradiation device 52.

As used herein in describing the various preferred embodiments of the present invention, the term "equal" encompasses "completely equal" and "substantially equal". Even if there is a small error between the above-described distances, if the difference is sufficiently small to make it difficult to cause printing unevenness as described below, such distances are encompassed in being "substantially equal". This is applicable also to the following description.

As shown in FIG. 3, distance D3 in the main scanning direction Y between middle position L2 in the main scanning direction Y of the second recording head 42 and middle position L5 in the main scanning direction Y of the third ultraviolet irradiation device 53 is equal to distance D4 in the main scanning direction Y between middle position L2 of the second recording head 42 and middle position L6 in the main scanning direction Y of the fourth ultraviolet irradiation device 54. In this preferred embodiment, distance D1, distance D2, distance D3 and distance D4 are equal to each other. Now, among the plurality of injection portions of the second recording head 42, the injection portions injecting the same type of ink will be referred to. The distance between the middle position in the main scanning direction Y of the left injection portion and middle position L5 of the third ultraviolet irradiation device 53 is equal to the distance between the middle position in the main scanning direction Y of the right injection portion and middle position L6 of the fourth ultraviolet irradiation device 54. For example, in FIG. 5, the injection portions 44G injecting the gloss ink will be referred to. The distance between middle position L21*a* of the left injection portion 44G and middle position L5 of the third ultraviolet irradiation device 53 is equal to the distance between middle position L21*b* of the right injection portion 44G and middle position L6 of the fourth ultraviolet irradiation device 54. In this example, middle positions L3 through L6 in the main scanning direction Y of the ultraviolet irradiation devices 51 through 54 are respectively the middle positions in the main scanning direction Y of ranges over which the ultraviolet irradiation devices 51 through 54 emit the ultraviolet rays. Middle positions L1 and L2 in the main scanning direction Y of the first recording head 41 and the second recording head 42 are respectively the middle positions in the main scanning direction Y of ranges over which the first recording head 41 and the second recording head 42 inject the ink.

In this preferred embodiment, the first ultraviolet irradiation device 51, the second ultraviolet irradiation device 52, the third ultraviolet irradiation device 53 and the fourth ultraviolet irradiation device 54 are independent from each other. Alternatively, the first ultraviolet irradiation device 51, the second ultraviolet irradiation device 52, the third ultraviolet irradiation device 53 and the fourth ultraviolet irradiation device 54 are may be integral with each other entirely or partially. For example, the ultraviolet irradiation devices located to the left of the first recording head 41 and the second recording head 42, namely, the first ultraviolet irradiation device 51 and the third ultraviolet irradiation device 53 may be integral with each other. The ultraviolet irradiation devices located to the right of the first recording head 41 and the second recording head 42, namely, the second ultraviolet irradiation device 52 and the fourth ultraviolet irradiation device 54 may be integral with each other. For example, an assembly of the first ultraviolet irradiation device 51 and the third ultraviolet irradiation device 53 may include a light emitting diode (LED) array-type ultraviolet irradiation device including an array of a plurality of LEDs, and an assembly of the second ultraviolet irradiation device 52 and the fourth ultraviolet irradiation device 54 may include an LED array-type ultraviolet irradiation device including an array of a plurality of LEDs. In this case, a controller 60 described below controls the LEDs provided in light emitting areas respectively corresponding to the ultraviolet irradiation devices 51, 52, 53 and 54 so as to be selectively lit up or lit off. In this manner, the number of components of the printer 1 is decreased.

Figure 6:
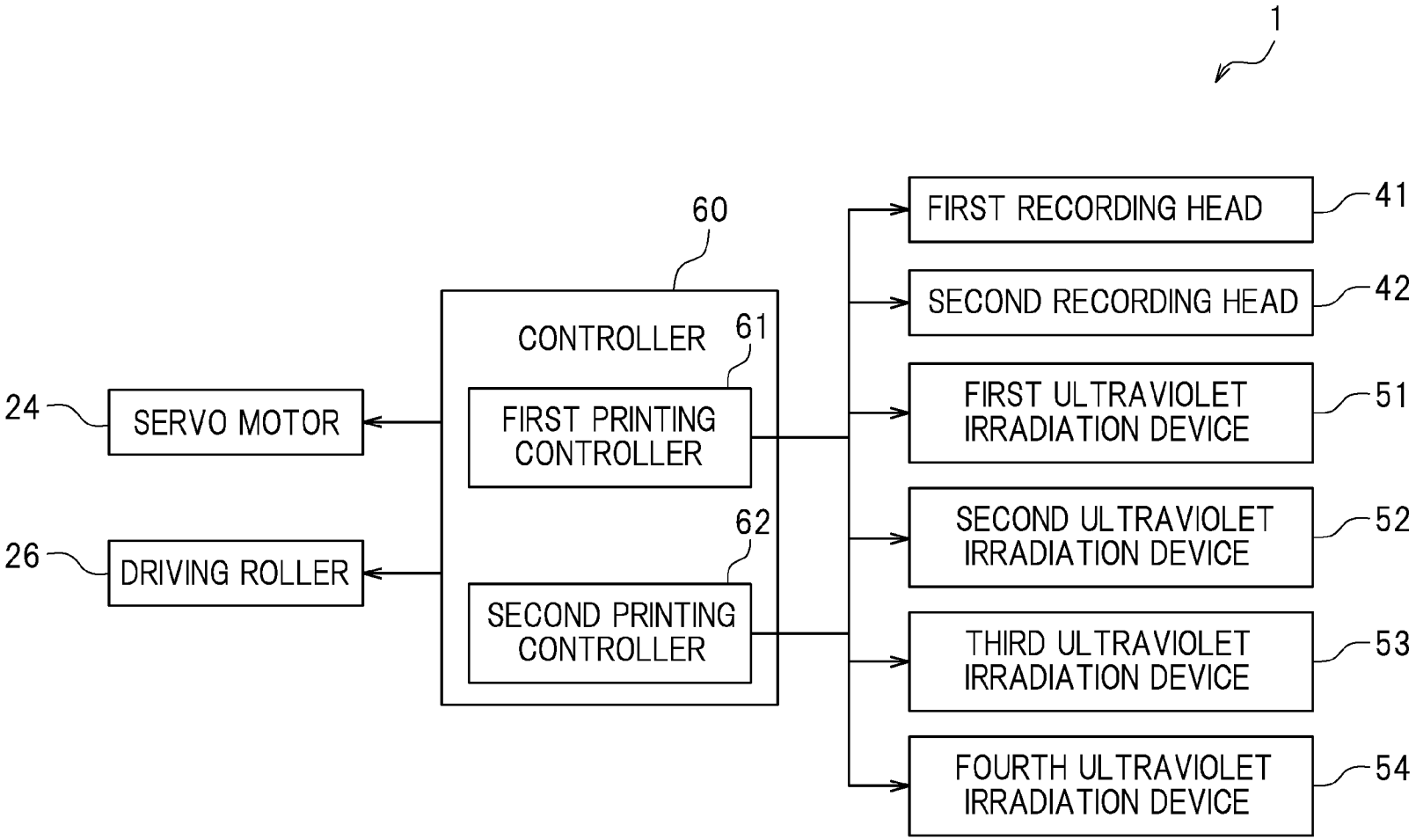
FIG. 6 is a block diagram showing a portion of the elements of the printer.

FIG. 6 is a block diagram showing a portion of elements of the printer 1. As shown in FIG. 6, the printer 1 includes the controller 60. The controller 60 includes a microcomputer and is provided in the printer 1. The controller 60 is configured or programmed to control the servo motor 24 running the belt 23, the driving roller among the rollers 26, the first recording head 41, the second recording head 42, the first ultraviolet irradiation device 51, the second ultraviolet irradiation device 52, the third ultraviolet irradiation device 53, and the fourth ultraviolet irradiation device 54. The controller 60 controls, for example, the moving speed of the carriage 30 (see FIG. 2) by controlling the servo motor 24. The controller 60 controls the movement of the recording paper sheet 5 in the sub scanning direction X by controlling the operation of the driving roller among the rollers 26. The controller 60 controls the ink injection operation of the first recording head 41 and the second recording head 42. The controller 60 controls the timing at which the ink injected onto the recording paper sheet 5 is irradiated with the ultraviolet rays by controlling the light emitting diodes of the ultraviolet irradiation devices 51, 52, 53 and 54. The controller 60 includes a first printing controller 61 and a second printing controller 62. The first printing controller 61 and the second printing controller 62 may be realized by software or hardware. For example, the first printing controller 61 and the second printing controller 62 may be executable by a processor or may be incorporated into a circuit.

The first printing controller 61 moves the first recording head 41 and the second recording head 42 in the main scanning direction Y. When the first recording head 41 injects ink toward the recording paper sheet 5, the first printing controller 61 causes the first ultraviolet irradiation device 51 or the second ultraviolet irradiation device 52 to provide the ultraviolet rays. Specifically, when the first recording head 41 injects ink while moving in the leftward direction Y1, the first printing controller 61 causes the second ultraviolet irradiation device 52 to provide the ultraviolet rays. When the first recording head 41 injects ink while moving in the rightward direction Y2, the first printing controller 61 causes the first ultraviolet irradiation device 51 to provide the ultraviolet rays.

When the second recording head 42 injects ink toward the recording paper sheet 5, the first printing controller 61 causes the third ultraviolet irradiation device 53 or the fourth ultraviolet irradiation device 54 to provide the ultraviolet rays. Specifically, when the second recording head 42 injects ink while moving in the leftward direction Y1, the first printing controller 61 causes the fourth ultraviolet irradiation device 54 to provide the ultraviolet rays. When the second recording head 42 injects ink while moving in the rightward direction Y2, the first printing controller 61 causes the third ultraviolet irradiation device 53 to provide the ultraviolet rays.

The second printing controller 62 moves the first recording head 41 and the second recording head 42 in the main scanning direction Y. The second printing controller 62 performs printing at a speed higher than the first printing controller 61. In this example, the speed at which the second printing controller 62 moves the first recording head 41 and the second recording head 42 in the main scanning direction Y is higher than the speed at which the first printing controller 61 moves the first recording head 41 and the second recording head 42 in the main scanning direction Y. For example, the speed at which the first printing controller 61 moves the first recording head 41 and the second recording head 42 preferably is about 500 mm/sec. In contrast, the speed at which the second printing controller 62 moves the first recording head 41 and the second recording head 42 preferably is about 1,000 mm/sec, for example. In the following description, the printing performed by the first printing controller 61 will be referred to as "low speed printing", and the printing performed by the second printing controller 62 will be referred to as "high speed printing". When the first recording head 41 or the second recording head 42 injects ink toward the recording paper sheet 5, the second printing controller 62 causes the first ultraviolet irradiation device 51 and the third ultraviolet irradiation device 53, or the second ultraviolet irradiation device 52 and the fourth ultraviolet irradiation device 54, to provide the ultraviolet rays. Specifically, when the first recording head 41 or the second recording head 42 injects ink while moving in the leftward direction Y1, the second printing controller 62 causes the second ultraviolet irradiation device 52 and the fourth ultraviolet irradiation device 54 to provide the ultraviolet rays. When the first recording head 41 or the second recording head 42 injects ink while moving in the rightward direction Y2, the second printing controller 62 causes the first ultraviolet irradiation device 51 and the third ultraviolet irradiation device 53 to provide the ultraviolet rays.

Now, a printing operation of the printer 1 in this preferred embodiment will be described. In this preferred embodiment, preferably there are two printing modes, namely, the low speed printing performed by the first printing controller 61 of the controller 60 and the high speed printing performed by the second printing controller 62 of the controller 60. Alternatively, there may be three or more printing modes between which the moving speed of the first recording head 41 and the second recording head 42 is different. For example, a user operates the operation panel 12 (see FIG. 1) to choose whether the printer 1 is to perform the low speed printing or the high speed printing.

In the low speed printing, the first printing controller 61 performs the printing. For example, the controller 60 controls the servo motor 24 to move the carriage 30 along the guide rail 20. At this point, the first recording head 41, the second recording head 42, and the ultraviolet irradiation devices 51, 52, 53 and 54 move in the main scanning direction Y along the guide rail 20. After the first recording head 41 and the second recording head 42 makes one cycle of scanning in the forward direction Y1 or the backward direction Y2, makes one cycle of round trip scanning, or makes a plurality of cycles of round trip scanning, the controller 60 drives the driving roller 26 to transport the recording paper sheet 5 in the sub scanning direction X. To perform the printing on the recording paper sheet 5 with the process color ink, the first printing controller 61 causes the first recording head 41 to inject the ink toward the recording paper sheet 5 while the first recording head 41 is moving in the leftward direction Y1 and the rightward direction Y2. While the first recording head 41 is moving in the leftward direction Y1, the first printing controller 61 causes the first recording head 41 to inject the ink from the nozzles 45 of the injection portions 43C, 43M, 43Y and 43K provided on the right side among the plurality of injection portions of the first recording head 41. Then, the controller 60 controls the first recording head 41, the second recording head 42, and the ultraviolet irradiation devices 51, 52, 53 and 54 to further move in the leftward direction Y1. At this point, the first printing controller 61 causes the second ultraviolet irradiation device 52 to emit light and thus causes the ink injected onto the recording paper sheet 5 to be irradiated with the ultraviolet rays. At this point, none of the first ultraviolet irradiation device 51, the third ultraviolet irradiation device 53 and the fourth ultraviolet irradiation device 54 emits light.

While the first recording head 41 is moving in the rightward direction Y2, the first printing controller 61 causes the first recording head 41 to inject the ink from the nozzles 45 of the injection portions 43C, 43M, 43Y and 43K provided on the left side among the plurality of injection portions of the first recording head 41. Then, the controller 60 controls the first recording head 41, the second recording head 42, and the ultraviolet irradiation devices 51, 52, 53 and 54 to further move in the rightward direction Y2. At this point, the first printing controller 61 causes the first ultraviolet irradiation device 51 to emit light and thus causes the ink injected onto the recording paper sheet 5 to be irradiated with the ultraviolet rays. At this point, none of the second ultraviolet irradiation device 52, the third ultraviolet irradiation device 53 and the fourth ultraviolet irradiation device 54 emits light.

To perform the low speed printing on the recording paper sheet 5 with the spot color ink, the first printing controller 61 causes the second recording head 42 to inject the ink toward the recording paper sheet 5 while the second recording head 42 is moving in the leftward direction Y1 and the rightward direction Y2. While the second recording head 42 is moving in the leftward direction Y1, the first printing controller 61 causes the second recording head 42 to inject the ink from the nozzle 46 of any one of the injection portions 44G, 44W and 44P provided on the right side among the plurality of injection portions of the second recording head 42. Then, the controller 60 controls the first recording head 41, the second recording head 42, and the ultraviolet irradiation devices 51, 52, 53 and 54 to further move in the leftward direction Y1. At this point, the first printing controller 61 causes the fourth ultraviolet irradiation device 54 to emit light and thus causes the ink injected onto the recording paper sheet 5 to be irradiated with the ultraviolet rays. At this point, none of the first ultraviolet irradiation device 51, the second ultraviolet irradiation device 52 and the third ultraviolet irradiation device 53 emits light.

While the second recording head 42 is moving in the rightward direction Y2, the first printing controller 61 causes the second recording head 42 to inject the ink from the nozzle 46 of any one of the injection portions 44G, 44W and 44P provided on the left side among the plurality of injection portions of the second recording head 42. Then, the controller 60 controls the first recording head 41, the second recording head 42, and the ultraviolet irradiation devices 51, 52, 53 and 54 to further move in the rightward direction Y2. At this point, the first printing controller 61 causes the third ultraviolet irradiation device 53 to emit light and thus causes the ink injected onto the recording paper sheet 5 to be irradiated with the ultraviolet rays. At this point, none of the first ultraviolet irradiation device 51, the second ultraviolet irradiation device 52 and the fourth ultraviolet irradiation device 54 emits light.

In the high speed printing, the second printing controller 62 performs the printing. To perform the printing on the recording paper sheet 5 with the process color ink and to perform the printing on the recording paper sheet 5 with the spot color ink, the operation performed until the ink is injected toward the recording paper sheet 5 is the same as that in the low speed printing and thus will not be described in detail. To perform the printing with the process color ink or the spot color ink in the leftward direction Y1, after the ink is injected toward the recording paper sheet 5, the second printing controller 62 causes the second ultraviolet irradiation device 52 and the fourth ultraviolet irradiation device 54 to emit light, and thus causes the ink injected onto the recording paper sheet 5 to be irradiated with the ultraviolet rays. At this point, neither the first ultraviolet irradiation device 51 nor the third ultraviolet irradiation device 53 emits light. By contrast, to perform the printing with the process color ink or the spot color ink in the rightward direction Y2, after the ink is injected toward the recording paper sheet 5, the second printing controller 62 causes the first ultraviolet irradiation device 51 and the third ultraviolet irradiation device 53 to emit light, and thus causes the ink injected onto the recording paper sheet 5 to be irradiated with the ultraviolet rays. At this point, neither the second ultraviolet irradiation device 52 nor the fourth ultraviolet irradiation device 54 emits light.

As described above, in this preferred embodiment, as shown in FIG. 3, distance D1 in the main scanning direction Y between middle position L1 in the main scanning direction Y of the first recording head 41 and middle position L3 in the main scanning direction Y of the first ultraviolet irradiation device 51 is equal to distance D2 in the main scanning direction Y between middle position L1 in the main scanning direction Y of the first recording head 41 and middle position L4 in the main scanning direction Y of the second ultraviolet irradiation device 52. In, for example, the low speed printing, the ink injected by the first recording head 41 while the first recording head 41 is moving in the leftward direction Y1 is cured by being irradiated with the ultraviolet rays by the second ultraviolet irradiation device 52. The ink injected by the first recording head 41 while the first recording head 41 is moving in the rightward direction Y2 is cured by being irradiated with the ultraviolet rays by the first ultraviolet irradiation device 51. Therefore, the time after the ink injected by the first recording head 41 while the first recording head 41 is moving in the leftward direction Y1 arrives at the recording paper sheet 5 until the ink starts to be cured by the ultraviolet rays is equal to the time after the ink injected by the first recording head 41 while the first recording head 41 is moving in the rightward direction Y2 arrives at the recording paper sheet 5 until the ink starts to be cured by the ultraviolet rays.

Distance D3 in the main scanning direction Y between middle position L2 in the main scanning direction Y of the second recording head 42 and middle position L5 in the main scanning direction Y of the third ultraviolet irradiation device 53 is equal to distance D4 in the main scanning direction Y between middle position L2 in the main scanning direction Y of the second recording head 42 and middle position L6 in the main scanning direction Y of the fourth ultraviolet irradiation device 54. In, for example, the low speed printing, the ink injected by the second recording head 42 while the second recording head 42 is moving in the leftward direction Y1 is cured by being irradiated with the ultraviolet rays by the fourth ultraviolet irradiation device 54. The ink injected by the second recording head 42 while the second recording head 42 is moving in the rightward direction Y2 is cured by being irradiated with the ultraviolet rays by the third ultraviolet irradiation device 53. Therefore, the time after the ink injected by the second recording head 42 while the second recording head 42 is moving in the leftward direction Y1 arrives at the recording paper sheet 5 until the ink starts to be cured by the ultraviolet rays is equal to the time after the ink injected by the second recording head 42 while the second recording head 42 is moving in the rightward direction Y2 arrives at the recording paper sheet 5 until the ink starts to be cured by the ultraviolet rays.

Figure 7:
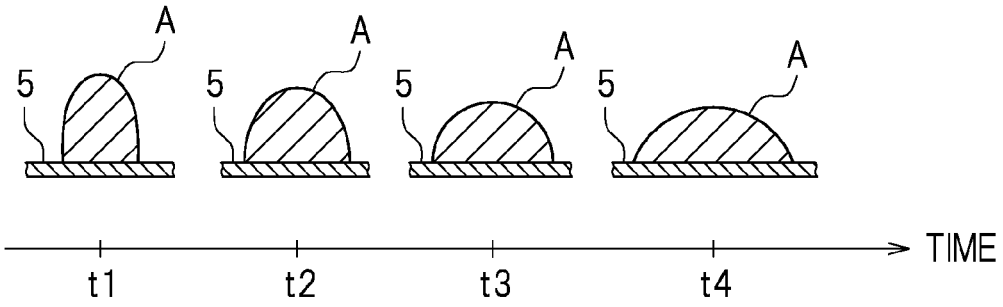
FIG. 7 shows a timewise change of ink injected onto a recording paper sheet.
Figure 8:
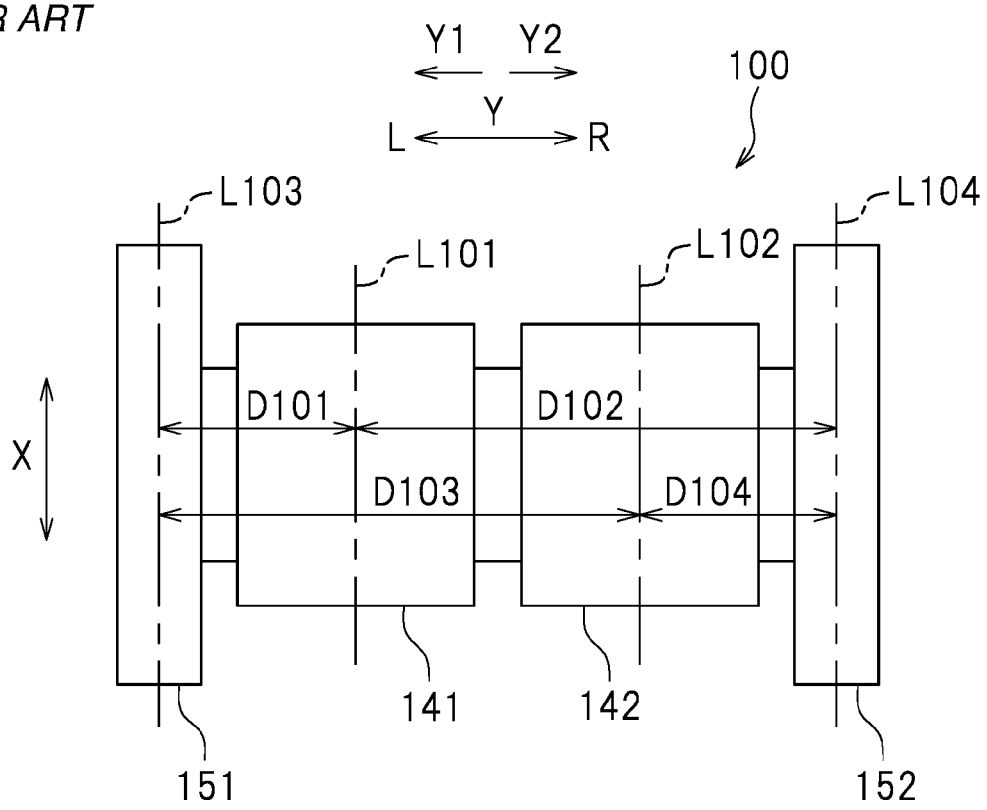
FIG.8 PRIOR ART
FIG. 8 is a plan view schematically showing a first recording head, a second recording head, a first ultraviolet irradiation device and a second ultraviolet irradiation device according to the prior art.

FIG. 7 shows a timewise change of ink A injected onto the recording paper sheet 5. As shown in FIG. 7, the ink A injected onto the recording paper sheet 5 by the first recording head 41 and the second recording head 42 has a dot diameter thereof increased as the time passes in the state where the ink A is not irradiated with the ultraviolet rays. In other words, the area size of the ink A, injected onto the recording paper sheet 5, that is in contact with the recording paper sheet 5 increases as the time passes in the state where the ink A is not irradiated with the ultraviolet rays. The ink A injected onto the recording paper sheet 5 expands in a horizontal direction on the recording paper sheet 5 as the time passes. For example, the dot diameter of the ink A at time t1 is shorter than the dot diameter of the ink A at each of time t2, time t3 and time t4, which have a longer time than time t1 after the start. As described above, the time after the ink injected by the first recording head 41 or the second recording head 42 while the first recording head 41 or the second recording head 42 is moving in the leftward direction Y1 arrives at the recording paper sheet 5 until the ink starts to be cured by the ultraviolet rays is equal to the time after the ink injected by the first recording head 41 or the second recording head 42 while the first recording head 41 or the second recording head 42 is moving in the rightward direction Y2 arrives at the recording paper sheet 5 until the ink starts to be cured by the ultraviolet rays. Therefore, in this preferred embodiment, the dot diameter of the ink injected by the first recording head 41 while the first recording head 41 is moving in the leftward direction Y1 is equal to the dot diameter of the ink injected by the first recording head 41 while the first recording head 41 is moving in the rightward direction Y2. Similarly, the dot diameter of the ink injected by the second recording head 42 while the second recording head 42 is moving in the leftward direction Y1 is equal to the dot diameter of the ink injected by the second recording head 42 while the second recording head 42 is moving in the rightward direction Y2. This significantly reduces or prevents printing unevenness on a printed item created by the ink injected by the first recording head 41 and the second recording head 42 onto the recording paper sheet 5.

In this preferred embodiment, as shown in FIG. 4, the injection portions 43C, 43M, 43Y and 43K of the first recording head 41 preferably are arrayed in the main scanning direction Y so as to be line-asymmetrical with middle position L1 in the main scanning direction Y of the first recording head 41 being the axis of symmetry. For example, distance D11*a* in the main scanning direction Y between middle position L1 in the main scanning direction Y of the first recording head 41 and the left injection portion 43C is equal to distance D11*b* in the main scanning direction Y between middle position L1 in the main scanning direction Y of the first recording head 41 and the right injection portion 43C. Distance D12*a* in the main scanning direction Y between middle position L1 in the main scanning direction Y of the first recording head 41 and the left injection portion 43M is equal to distance D12*b* in the main scanning direction Y between middle position L1 in the main scanning direction Y of the first recording head 41 and the right injection portion 43M. Because of such an arrangement, for example, the distance between the left injection portion 43C and the first ultraviolet irradiation device 51 is equal to the distance between the right injection portion 43C and the second ultraviolet irradiation device 52. Therefore, the time until the ink injected from the left injection portion 43C is cured by the ultraviolet rays is equal to the time until the ink injected from the right injection portion 43C is cured by the ultraviolet rays. Thus, the dot diameters of the ink injected from the two injection portions 43C are equal to each other. Similarly, the dot diameters of the ink injected from the two injection portions 43M are equal to each other. The dot diameters of the ink injected from the two injection portions 43Y are equal to each other. The dot diameters of the ink injected from the two injection portions 43K are equal to each other. This significantly reduces or prevents printing unevenness on a printed item created by the ink injected by the first recording head 41 onto the recording paper sheet 5.

In this preferred embodiment, as shown in FIG. 5, the injection portions 44G, 44W and 44P of the second recording head 42 are preferably arrayed in the main scanning direction Y so as to be line-asymmetrical with middle position L2 in the main scanning direction Y of the second recording head 42 being the axis of symmetry. For example, distance D21*a* in the main scanning direction Y between middle position L2 in the main scanning direction Y of the second recording head 42 and the left injection portion 44G is equal to distance D2 lb in the main scanning direction Y between middle position L2 in the main scanning direction Y of the second recording head 42 and the right injection portion 44G. Distance D22*a* in the main scanning direction Y between middle position L2 in the main scanning direction Y of the second recording head 42 and the left injection portion 44W is equal to distance D22*b* in the main scanning direction Y between middle position L2 in the main scanning direction Y of the second recording head 42 and the right injection portion 44W. Because of such an arrangement, for example, the distance between the left injection portion 44G and the third ultraviolet irradiation device 53 is equal to the distance between the right injection portion 44G and the fourth ultraviolet irradiation device 54. Therefore, the time until the ink injected from the left injection portion 44G is cured by the ultraviolet rays is equal to the time until the ink injected from the right injection portion 44G is cured by the ultraviolet rays. Thus, the dot diameters of the ink injected from the two injection portions 44G are equal to each other. Similarly, the dot diameters of the ink injected from the two injection portions 44W are equal to each other. The dot diameters of the ink injected from the two injection portions 44P are equal to each other. This significantly reduces or prevents printing unevenness on a printed item created by the ink injected by the second recording head 42 onto the recording paper sheet 5.

In this preferred embodiment, for example, while the first recording head 41 is moving in the leftward direction Y1, the first printing controller 61 causes the right injection portion 43C to inject the ink and causes the second ultraviolet irradiation device 52 to provide the ultraviolet rays. While the first recording head 41 is moving in the rightward direction Y2, the first printing controller 61 causes the left injection portion 43C to inject the ink and causes the first ultraviolet irradiation device 51 to provide the ultraviolet rays. Because of such an arrangement, the dot diameter of the ink injected from the right injection portion 43C of the first recording head 41 by the printing performed in the leftward direction Y1 is equal to the dot diameter of the ink injected from the left injection portion 43C of the first recording head 41 by the printing performed in the rightward direction Y2. This significantly reduces or prevents printing unevenness on a printed item created by the ink injected by the first recording head 41 onto the recording paper sheet 5.

In this preferred embodiment, in the low speed printing and the high speed printing performed in the leftward direction Y1 and the rightward direction Y2, any ultraviolet irradiation device passing over the recording paper sheet 5 before the ink is injected toward the recording paper sheet 5 does not emit light. In the printing performed in the leftward direction and the printing performed in the rightward direction, the ultraviolet irradiation devices to emit light are switched. This decreases the electric power consumed to cause the ultraviolet irradiation devices 51, 52, 53 and 54 to emit light. In this example, the ultraviolet irradiation devices 51, 52, 53 and 54 each include a light emitting diode. Therefore, it is easy to switch the ultraviolet irradiation device to emit light.

Now, a printer according to a modification of a preferred embodiment of the present invention will be described. In the above-described preferred embodiments, while the first recording head is moving in the leftward direction Y1, the first printing controller 61 and the second printing controller 62 cause the ink to be injected from the right injection portions 43C, 43M, 43Y and 43K among the injection portions 43C, 43M, 43Y and 43K of the first recording head 41. While the first recording head 41 is moving in the rightward direction Y2, the first printing controller 61 and the second printing controller 62 cause the ink to be injected from the left injection portions 43C, 43M, 43Y and 43K among the injection portions 43C, 43M, 43Y and 43K of the first recording head 41. Alternatively, in the printing performed in the leftward direction Y1 and the printing performed in the rightward direction Y2, the injection portions 43C, 43M, 43Y and 43K to inject the ink may be opposite to the above. For example, while the first recording head is moving in the leftward direction Y1, the first printing controller 61 and the second printing controller 62 may cause the ink to be injected from the left injection portions 43C, 43M, 43Y and 43K. While the first recording head 41 is moving in the rightward direction Y2, the first printing controller 61 and the second printing controller 62 may cause the ink to be injected from the right injection portions 43C, 43M, 43Y and 43K. Still alternatively, in the printing performed in the leftward direction Y1 and the printing performed in the rightward direction Y2, the ink may be injected from the left and right injection portions 43C, 43M, 43Y and 43K. Still alternatively, in the printing performed in the leftward direction Y1 and the printing performed in the rightward direction Y2, the first printing controller 61 and the second printing controller 62 may be controlled to select the injection portions 43C, 43M, 43Y and 43K from which the ink is to be injected, namely, the left injection portions 43C, 43M, 43Y and 43K or the right injection portions 43C, 43M, 43Y and 43K, for each cycle of printing. This allows the printing quality to be changed for each cycle of printing. The above-described modifications are applicable to the printing performed by the second recording head 42.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:

a guide rail extending in a main scanning direction;

a first recording head slidably in engagement with the guide rail, the first recording head injecting ultraviolet-curable ink toward a recording medium at least either while moving in a forward direction from one side to the other side of the main scanning direction or while moving in a backward direction from the other side to the one side of the main scanning direction;

a second recording head provided on the one side or the other side of the main scanning direction with respect to the first recording head and slidably in engagement with the guide rail, the second recording head injecting ultraviolet-curable ink toward the recording medium at least either while moving in the forward direction or while moving in the backward direction;

a first ultraviolet irradiation device provided on the other side of the main scanning direction with respect to the first recording head, the first ultraviolet irradiation device irradiating the ultraviolet-curable ink injected onto the recording medium with ultraviolet rays;

a second ultraviolet irradiation device provided on the one side of the main scanning direction with respect to the first recording head, the second ultraviolet irradiation device irradiating the ultraviolet-curable ink injected onto the recording medium with ultraviolet rays;

a third ultraviolet irradiation device provided on the other side of the main scanning direction with respect to the second recording head, the third ultraviolet irradiation device irradiating the ultraviolet-curable ink injected onto the recording medium with ultraviolet rays; and a fourth ultraviolet irradiation device provided on the one side of the main scanning direction with respect to the second recording head, the fourth ultraviolet irradiation device irradiating the ultraviolet-curable ink injected onto the recording medium with ultraviolet rays; wherein the first recording head includes a first nozzle line, a second nozzle line, a third nozzle line and a fourth nozzle line each including a plurality of nozzles arrayed in a sub scanning direction perpendicular to the main scanning direction;

the first nozzle line and the second nozzle line inject first ink;

the second recording head includes spot color ink that is injected from the second recording head;

the third nozzle line and the fourth nozzle line inject second ink;

as seen from the one side of the main scanning direction, each of the first ultraviolet irradiation device, the second ultraviolet irradiation device, the third ultraviolet irradiation device and the fourth ultraviolet irradiation device at least partially overlaps the first recording head and the second recording head;

a distance in the main scanning direction between a middle position in the main scanning direction of the first recording head and a middle position in the main scanning direction of the first ultraviolet irradiation device is equal or substantially equal to a distance in the main scanning direction between the middle position in the main scanning direction of the first recording head and a middle position in the main scanning direction of the second ultraviolet irradiation device;

a distance in the main scanning direction between a middle position in the main scanning direction of the second recording head and a middle position in the main scanning direction of the third ultraviolet irradiation device is equal or substantially equal to a distance in the main scanning direction between the middle position in the main scanning direction of the second recording head and a middle position in the main scanning direction of the fourth ultraviolet irradiation device;

the first nozzle line and the third nozzle line are located on the one side of the main scanning direction with respect to the middle position in the main scanning direction of the first recording head;

the second nozzle line and the fourth nozzle line are located on the other side of the main scanning direction with respect to the middle position in the main scanning direction of the first recording head;

a distance in the main scanning direction between the middle position in the main scanning direction of the first recording head and the first nozzle line is equal or substantially equal to a distance in the main scanning direction between the middle position in the main scanning direction of the first recording head and the second nozzle line; and a distance in the main scanning direction between the middle position in the main scanning direction of the first recording head and the third nozzle line is equal or substantially equal to a distance in the main scanning direction between the middle position in the main scanning direction of the first recording head and the fourth nozzle line.

2. An inkjet printer, comprising:

a guide rail extending in a main scanning direction;

a first recording head slidably in engagement with the guide rail, the first recording head injecting ultraviolet-curable ink toward a recording medium at least either while moving in a forward direction from one side to the other side of the main scanning direction or while moving in a backward direction from the other side to the one side of the main scanning direction;

a second recording head provided on the one side or the other side of the main scanning direction with respect to the first recording head and slidably in engagement with the guide rail, the second recording head injecting ultraviolet-curable ink toward the recording medium at least either while moving in the forward direction or while moving in the backward direction;

a first ultraviolet irradiation device provided on the other side of the main scanning direction with respect to the first recording head, the first ultraviolet irradiation device irradiating the ultraviolet-curable ink injected onto the recording medium with ultraviolet rays;

a second ultraviolet irradiation device provided on the one side of the main scanning direction with respect to the first recording head, the second ultraviolet irradiation device irradiating the ultraviolet-curable ink injected onto the recording medium with ultraviolet rays;

a third ultraviolet irradiation device provided on the other side of the main scanning direction with respect to the second recording head, the third ultraviolet irradiation device irradiating the ultraviolet-curable ink injected onto the recording medium with ultraviolet rays; and a fourth ultraviolet irradiation device provided on the one side of the main scanning direction with respect to the second recording head, the fourth ultraviolet irradiation device irradiating the ultraviolet-curable ink injected onto the recording medium with ultraviolet rays; wherein the second recording head includes spot color ink that is injected from the second recording head;

the second recording head includes a first nozzle line, a second nozzle line, a third nozzle line and a fourth nozzle line each including a plurality of nozzles arrayed in a sub scanning direction perpendicular to the main scanning direction;

the first nozzle line and the second nozzle line inject first ink;

the third nozzle line and the fourth nozzle line inject second ink;

as seen from the one side of the main scanning direction, each of the first ultraviolet irradiation device, the second ultraviolet irradiation device, the third ultraviolet irradiation device and the fourth ultraviolet irradiation device at least partially overlaps the first recording head and the second recording head;

a distance in the main scanning direction between a middle position in the main scanning direction of the first recording head and a middle position in the main scanning direction of the first ultraviolet irradiation device is equal or substantially equal to a distance in the main scanning direction between the middle position in the main scanning direction of the first recording head and a middle position in the main scanning direction of the second ultraviolet irradiation device;

a distance in the main scanning direction between a middle position in the main scanning direction of the second recording head and a middle position in the main scanning direction of the third ultraviolet irradiation device is equal or substantially equal to a distance in the main scanning direction between the middle position in the main scanning direction of the second recording head and a middle position in the main scanning direction of the fourth ultraviolet irradiation device;

the first nozzle line and the third nozzle line are located on the one side of the main scanning direction with respect to the middle position in the main scanning direction of the second recording head;

the second nozzle line and the fourth nozzle line are located on the other side of the main scanning direction with respect to the middle position in the main scanning direction of the second recording head;

a distance in the main scanning direction between the middle position in the main scanning direction of the second recording head and the first nozzle line is equal or substantially equal to a distance in the main scanning direction between the middle position in the main scanning direction of the second recording head and the second nozzle line; and a distance in the main scanning direction between the middle position in the main scanning direction of the second recording head and the third nozzle line is equal or substantially equal to a distance in the main scanning direction between the middle position in the main scanning direction of the second recording head and the fourth nozzle line.

3. An inkjet printer, comprising:

a guide rail extending in a main scanning direction;

a first recording head slidably in engagement with the guide rail, the first recording head injecting ultraviolet-curable ink toward a recording medium at least either while moving in a forward direction from one side to the other side of the main scanning direction or while moving in a backward direction from the other side to the one side of the main scanning direction;

a second recording head provided on the one side or the other side of the main scanning direction with respect to the first recording head and slidably in engagement with the guide rail, the second recording head injecting ultraviolet-curable ink toward the recording medium at least either while moving in the forward direction or while moving in the backward direction;

a first ultraviolet irradiation device provided on the other side of the main scanning direction with respect to the first recording head, the first ultraviolet irradiation device irradiating the ultraviolet-curable ink injected onto the recording medium with ultraviolet rays;

a second ultraviolet irradiation device provided on the one side of the main scanning direction with respect to the first recording head, the second ultraviolet irradiation device irradiating the ultraviolet-curable ink injected onto the recording medium with ultraviolet rays;

a third ultraviolet irradiation device provided on the other side of the main scanning direction with respect to the second recording head, the third ultraviolet irradiation device irradiating the ultraviolet-curable ink injected onto the recording medium with ultraviolet rays; and a fourth ultraviolet irradiation device provided on the one side of the main scanning direction with respect to the second recording head, the fourth ultraviolet irradiation device irradiating the ultraviolet-curable ink injected onto the recording medium with ultraviolet rays; wherein the first recording head includes a first nozzle line and a second nozzle line each including a plurality of nozzles arrayed in a sub scanning direction perpendicular to the main scanning direction;

the first nozzle line is located on the one side of the main scanning direction with respect to a middle position in the main scanning direction of the first recording head;

the second nozzle line is located on the other side of the main scanning direction with respect to the middle position in the main scanning direction of the first recording head;

the second recording head includes spot color ink that is injected from the second recording head;

as seen from the one side of the main scanning direction, each of the first ultraviolet irradiation device, the second ultraviolet irradiation device, the third ultraviolet irradiation device and the fourth ultraviolet irradiation device at least partially overlaps the first recording head and the second recording head;

a distance in the main scanning direction between the middle position in the main scanning direction of the first recording head and a middle position in the main scanning direction of the first ultraviolet irradiation device is equal or substantially equal to a distance in the main scanning direction between the middle position in the main scanning direction of the first recording head and a middle position in the main scanning direction of the second ultraviolet irradiation device;

a distance in the main scanning direction between a middle position in the main scanning direction of the second recording head and a middle position in the main scanning direction of the third ultraviolet irradiation device is equal or substantially equal to a distance in the main scanning direction between the middle position in the main scanning direction of the second recording head and a middle position in the main scanning direction of the fourth ultraviolet irradiation device;

a distance in the main scanning direction between the middle position in the main scanning direction of the first recording head and the first nozzle line is equal or substantially equal to a distance in the main scanning direction between the middle position in the main scanning direction of the first recording head and the second nozzle line; and the inkjet printer includes a controller configured or programmed to, while the first recording head is moving in the forward direction, cause one of the first nozzle line and the second nozzle line to inject the ultraviolet-curable ink and cause the second ultraviolet irradiation device to provide the ultraviolet rays, and while the first recording head is moving in the backward direction, cause the other of the first nozzle line and the second nozzle line to inject the ultraviolet-curable ink and cause the first ultraviolet irradiation device to provide the ultraviolet rays.

* * * * *